US005501243A

United States Patent [19]

Palazzo

[11] Patent Number: 5,501,243

[45] Date of Patent: Mar. 26, 1996

[54] LIQUID STORAGE TANK SUMP

[76] Inventor: David T. Palazzo, P.O. Box 290676, Tampa, Fla. 33687

[21] Appl. No.: 315,422

[22] Filed: Sep. 30, 1994

[51] Int. Cl.[6] ..... B67D 5/00

[52] U.S. Cl. ..... 137/15; 137/312; 137/558; 141/86; 141/95

[58] Field of Search ..... 137/15, 312, 558; 141/86, 88, 95

[56] References Cited

U.S. PATENT DOCUMENTS

| | | | |
|---|---|---|---|
| 231,924 | 9/1880 | McKenzie | 220/4.26 X |
| 753,600 | 3/1904 | Maul | 141/95 X |
| 2,171,972 | 9/1939 | Debor | 220/4.26 X |
| 2,935,099 | 5/1960 | Haynes | 141/95 |
| 3,548,779 | 12/1970 | Green | 141/95 X |
| 4,520,852 | 6/1985 | Klein | 141/86 |
| 4,762,440 | 8/1988 | Argandona | 137/312 X |
| 4,856,564 | 8/1989 | Obal | 141/86 X |
| 4,871,084 | 10/1989 | Robbins | 141/86 X |
| 4,896,705 | 1/1990 | Podgers et al. | 141/86 |
| 4,986,436 | 1/1991 | Bambacigno et al. | 141/86 X |
| 5,058,633 | 10/1991 | Sharp | 141/86 |
| 5,060,509 | 10/1991 | Webb | 137/312 X |
| 5,085,257 | 2/1992 | Smith | 141/86 |
| 5,257,652 | 11/1993 | Lawrence | 141/86 |

FOREIGN PATENT DOCUMENTS

| | | | |
|---|---|---|---|
| 1270237 | 12/1961 | France | 141/86 |

*Primary Examiner*—John Rivell
*Attorney, Agent, or Firm*—Pettis & McDonald

[57] ABSTRACT

An apparatus and a member therefor are disclosed for a sump assembly installed in a liquid storage tank having an exterior portion and a tank wall with an aperture extending through a portion of the tank wall, a generally cylindrical sump collar attached within said aperture having an open outer extremity and having an inner extremity closed by a base member attached to that inner extremity, a generally cylindrical sump housing fitting into the sump collar, and means for sealingly attaching the sump housing to the sump collar, so that the sump housing and the sump collar form a liquid containment chamber.

10 Claims, 3 Drawing Sheets

LIQUID STORAGE TANK SUMP

FIELD OF THE INVENTION

This invention relates to a sump for use in liquid storage tanks.

BACKGROUND OF THE INVENTION

Tanks for the storage of liquids are well known and have been constructed for many years. These tanks can be constructed in a variety of ways and from a variety of materials. Often liquids are stored in underground tanks. For this and other reasons relating to leak prevention, fittings through which liquid is introduced or removed are often at the top of the tank.

When hazardous or valuable liquids are stored it becomes desirable to prevent these liquids from escaping due to leaks in the fittings or the pump outside and/or above the tank. In addition, it is desirable to prevent leaks that may occur at other points, such as connections between the fittings and other piping, and that may also occur at the juncture where fittings pass through tank walls. Additionally, it is desirable to prevent rain water and other liquids as well as solids from mixing in with the liquid being stored.

For safety reasons liquid storage tanks, particularly when designed for underground use, are now preferably constructed with a double wall. A convenient method of building a double wall tank is disclosed in U.S. Pat. No. 4,640,435 and subsequent patents relating thereto.

SUMMARY OF THE INVENTION

In view of the foregoing it is the object of the present invention to provide an economical apparatus and method of trapping liquids and solids by introducing a sump to an opening of a tank.

To achieve these and other objects that will become readily apparent to those skilled in the art, this invention provides an apparatus and a method therefor for a sump assembly installed in a liquid storage tank having an exterior portion and a tank wall with an aperture having a periphery extending through a portion of the tank wall, comprising a generally cylindrical sump collar attached within said aperture which collar includes a peripheral wall having an outer extremity and a base engaging the periphery of said aperture, and having an open outer extremity and a base closed by a member attached to the base of the peripheral wall, with a generally cylindrical sump housing fitting into the collar outer extremity, and structure for sealingly attaching the sump housing to the sump collar, so that the sump housing and the sump collar base form a liquid containment chamber.

BRIEF DESCRIPTION OF THE DRAWINGS

Particularly preferred embodiments of the method and apparatus of this invention will be described in detail below in connection with the drawings in which.

DESCRIPTION OF PREFERRED EMBODIMENT

Figure 1:
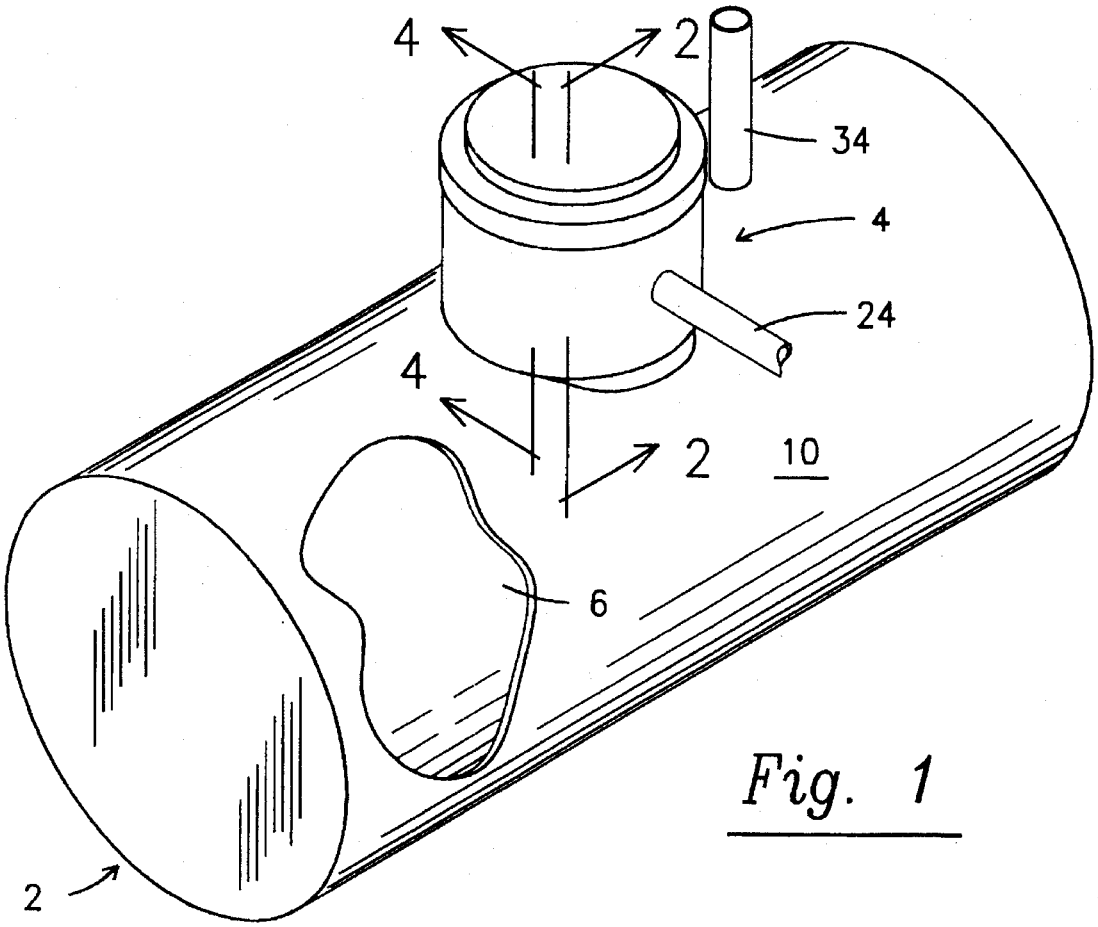
FIG. 1 is a perspective view of a tank installed with a sump according to the present invention.

Preferred embodiments of the apparatus of this invention are illustrated in FIGS. 1 through 7. FIG. 1 illustrates a perspective view of a liquid storage tank incorporating the present invention. Aa shown in the sectional view of FIG. 2, a liquid storage tank, generally indicated as 2, receives the sump assembly, generally indicated as 4, of the present invention into an aperture extending through an upwardly facing portion of the tank wall 6, the aperture being defined by its periphery 8. Although a preferred embodiment of aperture periphery 8 may conveniently be a generally circular shape, other geometrical shapes for aperture periphery 8 are suitable for the present invention. The tank wall 6 may conveniently have an exterior portion to which a layer 10 of sheet material is applied to produce a double wall liquid storage tank 2, as described in my above-referenced prior patents. Although the tank 2 is depicted and described as being double-walled, this invention may suitably be used with equal benefits on other tanks including single-walled tanks.

Figure 2:
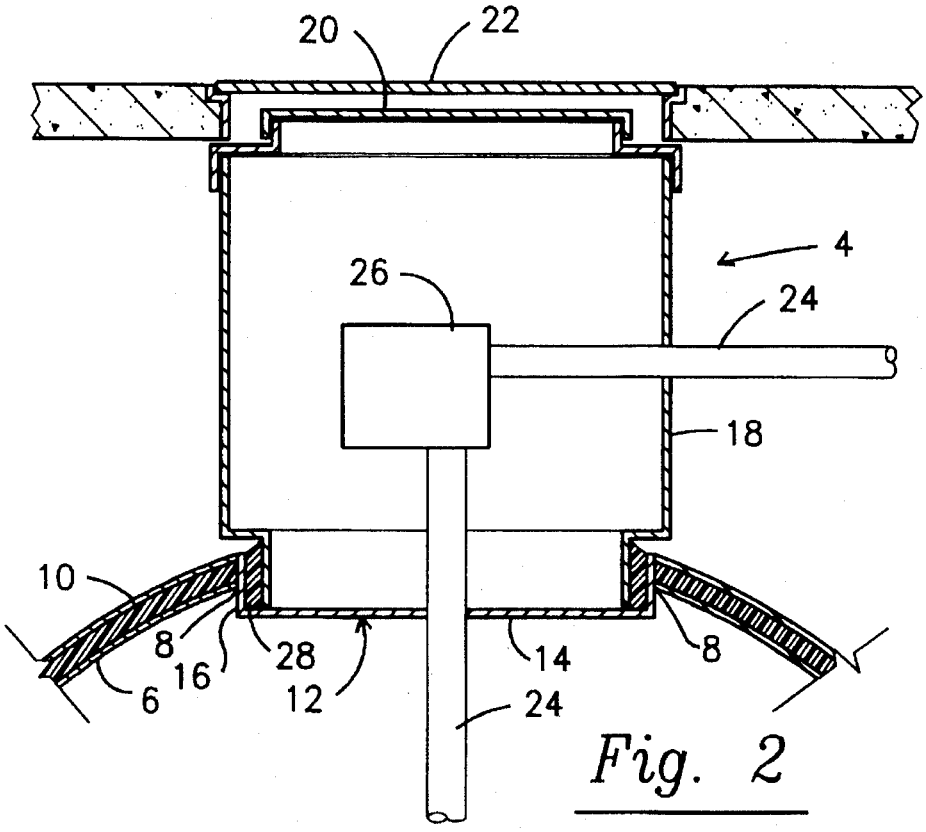
FIG. 2 is a fragmentary side sectional view of the tank of FIG. 1, taken along line 2—2.

FIG. 2 is a side sectional view of the sump assembly 4 of the present invention taken along line 2—2 of FIG. 1. The sump collar, generally indicated as 12, is sealingly attached within the aperture defined by the aperture periphery 8, suitably by welding, use of synthetic resins or by other well-known means. During construction of the tank or afterwards, the aperture is formed in the tank and may conveniently be shaped so that a generally cylindrical sump collar 12 can be sealingly attached to the aperture periphery 8. Sump collar 12 has a base member 14 to which a peripheral wall 16, having a top or outer extremity and a bottom or inner extremity, is attached by welding, bolting, or other well known means. The sump collar 12 may conveniently have a generally cylindrical shape that is defined by the base member 14 and a peripheral wall 16, with the outer extremity of the sump collar being open. The base member 14 is a member that closes the bottom or inner extremity of the sump collar 12 by attaching to the bottom or inner extremity of the peripheral wall 16 to form a durable seal that conveniently may be liquid tight.

The sump collar 12 is inserted into the tank aperture. Insertion may conveniently be performed so that the outer extremity of peripheral wall 16 extends beyond aperture periphery 8, as depicted in FIG. 2. If construction of a double wall tank 2 involves wrapping the layer 10 of sheet material around the tank 2 as disclosed in my prior patents referenced above, then before the sump housing 18 is attached to the sump collar 12 the tank 2 has a layer 10 of sheet material applied to the exterior of the tank wall 6 as disclosed in my referenced patents. Once the layer 10 is applied to the exterior of the tank wall 6, the portion of sheet material 10 overlying sump collar 12 is removed, so that the open top of the sump collar 12 has substantially none of the sheet material 10 covering it.

A preferred embodiment of the sump housing 18 may conveniently involve a generally cylindrical sump housing 18 having a portion receivable into the sump collar 12. During installation of the sump assembly 4, after the layer 10 of sheet material is cut from the area overlying sump collar 12, the sump housing 18 is fitted into the open top of the sump collar 12 and may conveniently rest upon the base 14 of sump collar 12. The portion of the sump housing 18 that extends beyond the peripheral wall 16 of the sump collar 12 may be any shape for the purposes of this invention, and may conveniently be any polygonal cylindrical shape extending generally upward from the tank 2, such shape conveniently resulting from welding sheet steel into overlapping plates. In a preferred embodiment, the sump housing 18 has a lid 20 beneath the manhole cover 22 that is typically at street level as shown in FIG. 1. Although neither the shape nor the construction materials of the sump housing 18 and sump collar 12 are critical to the present invention, preferred embodiments are generally cylindrical and constructed of welded sheet steel. Other construction materials, particularly for use with tanks for storing liquids known to be corrosive to steel, may suitably be used as known to those skilled in the art.

Fluid conduits 24 pass through the sump collar 12 and the sump housing 18. In a preferred embodiment openings by which fluid conduits 24 pass through the sump collar 12 and sump housing 18 are sealed against passage of fluids, so that fluid conduits 24 pass sealingly into and out of the sump assembly 4.

To protect against leaks in the fluid conduits or associated fittings 24, as well as leaks in fluid pump 26, a liquid containment chamber is formed by the sump housing 18 and sump collar 12. To provide liquid integrity of the sump assembly 4 and the liquid containment chamber, means 28 for sealing the sump housing 18 to the sump collar 12 are inserted, conveniently between the peripheral wall 16 of the sump collar 12 and the sump housing 18, so that fluid travel from the sump assembly 4 to the exterior of the tank 2 is prevented. In a preferred embodiment, means 28 for sealing may conveniently be a synthetic resin or any other suitable sealing material 28 known to those skilled in the art.

Figure 3:
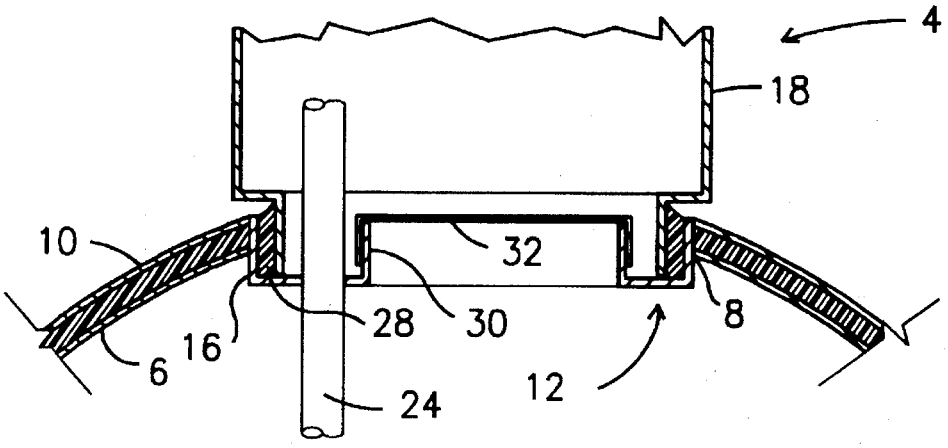
FIG. 3 is a fragmentary side sectional view of the sump of FIG. 2, depicting a fitting and a manway.

In an alternative embodiment shown in a side sectional view in FIG. 3, a manway 30 may conveniently be installed into base 14 to provide access into tank 2. In this preferred embodiment, a manway cover 32 may conveniently be attached to manway 30 when not in use, and may suitably form a liquid seal with manway 30 so that liquids in the liquid containment chamber formed by sump assembly 4 do not escape into the tank.

Figure 4:
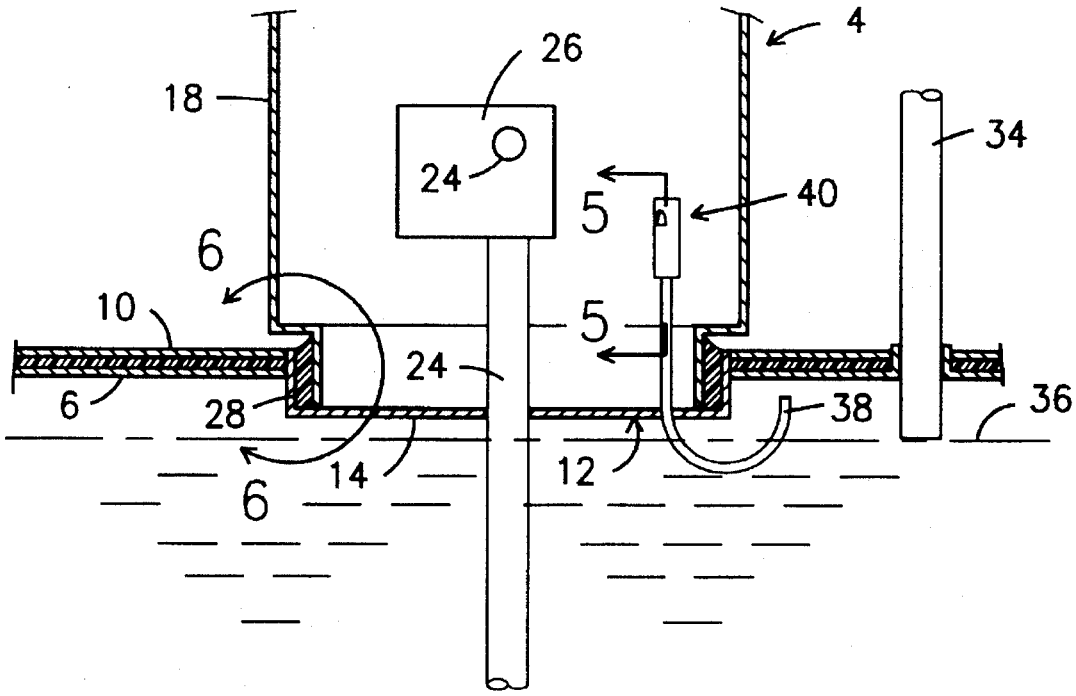
FIG. 4 is a side sectional view taken along line 4—4 of FIG. 1 of the sump according to the present invention incorporating a whistle pipe and a vent pipe.

In the sectional view of FIG. 4 a whistle pipe 38 and vent pipe 34 are disclosed. During filling of underground liquid storage tank 2 the liquid flows from the truck through a hose into tank 2. As liquid enters tank 2, air trapped in an upper portion of the tank 2 must be expelled to maintain incoming liquid flow. Under the incoming pressure air escapes through vent pipe 34. As the tank 2 approaches its capacity of liquid, the liquid level 36 reaches the bottom of vent pipe 34 and prevents passage of air trapped in the upper portion of tank 2 through vent pipe 34. This indicates that tank 2 has reached an optimal capacity. The present art requires that liquid in the hose that cannot be emptied into tank 2 without a pressure pump be retrieved into the dispensing truck. A convenient result of the following embodiment is that the hose may be emptied into the tank simply by shutting off flow at the truck end and allowing the hose to drain into the tank.

A whistle pipe 38 extends through base 14 of the sump collar 12 downwardly and then curving upwardly, so that a first end of the whistle pipe 38 is adjacent to an upper surface of the interior tank wall 6, which may comprise an upper surface of the interior of tank 2, with a second end of whistle pipe 38 extending generally upwardly from the base 14 within the sump assembly 4. The second end has a whistle, generally indicated as 40, mounted to it. When the liquid level 36 reaches the bottom of vent pipe 34, whistle 40 is responsive to either increased pressure of, or increased flow of, air trapped in the upper portion of tank 2 through the whistle pipe 38. If whistle 38 is responsive to increased air flow resulting from the vent pipe 34 being closed, then it may conveniently be a simple whistle known to the art.

Figure 5:
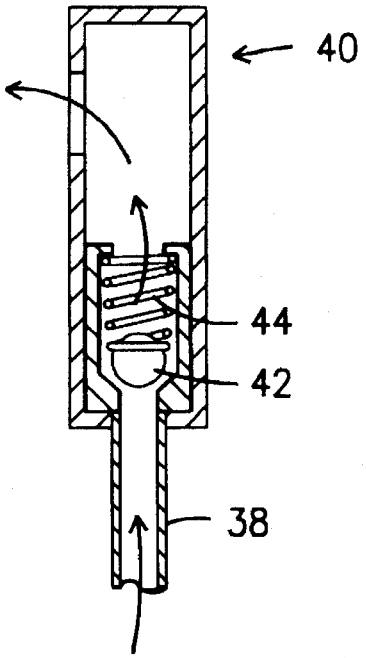
FIG. 5 is a sectional view of the whistle pipe taken along line 5—5 of FIG. 4.

A preferred embodiment of whistle 40 is depicted in the sectional view of FIG. 5., taken along line 5—5 of FIG. 4. This preferred embodiment is responsive to an increase in pressure in the air trapped in the upper portion of the tank 2. Ball 42 is trapped by spring 44 until the pressure in whistle pipe 38 is sufficient to dislodge ball 42. Thus, whistle 40 only begins operation under increased pressure and may suitably indicate an overfill condition of tank 2.

Figure 6:
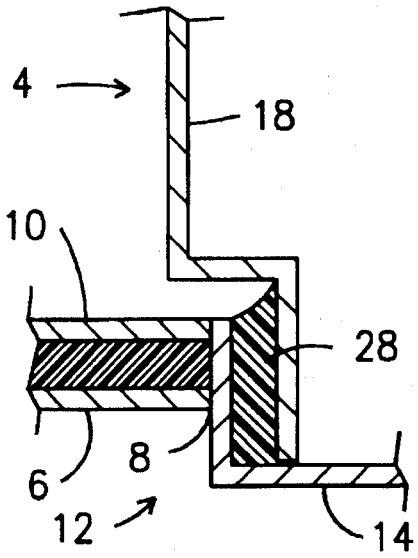
FIG. 6 is a fragmentary view taken along line 6—6 of FIG. 4 of the seal between the sump collar and the sump housing.
Figure 7:
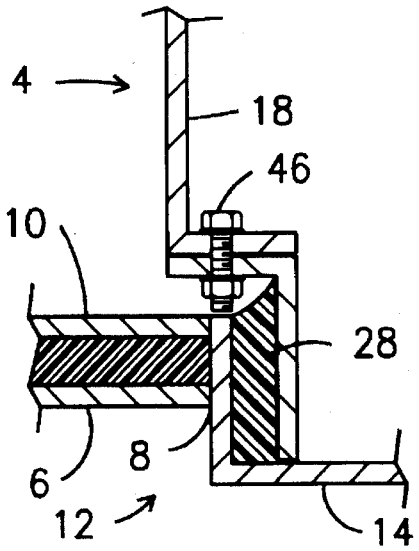
FIG. 7 is an alternative embodiment of the sump housing depicted in FIG. 6.

FIG. 6, a fragmentary view taken along line 6—6 of FIG. 4, provides an expanded view of the means 28 for sealing, demonstrating the preferred upward escape path to which leaking liquids are constrained by this invention. An alternative embodiment of sump housing 14 is shown in FIG. 7, in which an upper part of sump housing 18 is bolted to a lower part by bolts 46 or other means of attachment. This has the advantage of even more convenient assembly to tank 2.

Although FIGS. 1–7 depict the tank 2 and sump assembly 4 in a vertical orientation, this invention can be practiced with equal efficiency if the tank 2 is in any other orientation. Throughout this specification and the claims appended hereto, sump collar 12 and peripheral wall 16 are described as having a top or top ends. If the sump assembly 4 is in an orientation other than the one depicted, "top" shall be defined as the direction that would be upward if the sump were rotated to the depicted orientation, for example, of FIG. 1. This applies equally to the terms "downwardly" or "upwardly" when used in conjunction with the sump assembly 4. When in the depicted orientation, "top" shall be synonymous with "outer extremity."

While the foregoing describes in detail several preferred embodiments of the tank of this invention, it is to be understood that such description is illustrative only of the principles of the invention and is not to be considered limitative thereof. Because numerous variations and modifications of both the method of manufacture and the resulting sump will readily occur to those skilled in the art, the scope of this invention is to be limited solely by the claims appended hereto.

What is claimed is:

1. A method of installing a sump assembly into a liquid storage tank having an exterior portion and a tank wall with an aperture having a periphery extending through a portion of said tank wall, said method comprising the steps of sealingly attaching within said aperture a generally cylindrical sump collar comprising a peripheral wall engaging the periphery of said aperture, said collar peripheral wall having an open outer extremity and having an inner extremity closed by a base member attached to said inner extremity of said peripheral wall;

fitting a generally cylindrical sump housing into said collar; and sealingly attaching said sump housing to said sump collar, whereby said sump housing and said sump collar form a liquid containment chamber.

2. The method of installing a sump assembly of claim 1 wherein said aperture extends through an upwardly facing portion of said tank wall.

3. The method of installing a sump assembly of claim 2 further comprising the steps of applying a layer of sheet material over the exterior of said tank after said sump collar is attached but before said sump housing is attached; and removing said sheet material from the exterior portion of said tank surrounded by said sump collar, such that said collar open outer extremity has substantially none of said sheet material covering it.

4. The method of installing a sump assembly of claim 3 further comprising the step of passing at least one fluid conduit through said base member.

5. The method of installing a sump assembly of claim 4 further comprising the step of passing a whistle pipe through said base member, said whistle pipe comprising a tube extending downwardly through said base member and then curving upwardly such that a first end of said tube is adjacent an upper surface of the interior of said tank with a second end of said tube extending within said sump housing and having a whistle activated by air flow therethrough.

6. A sump assembly for a liquid storage tank having an exterior portion and a tank wall with an aperture having a periphery extending through a portion of said tank wall, said sump assembly comprising a generally cylindrical sump collar sealingly attached within said aperture and comprising a peripheral wall engaging the periphery of said aperture, said peripheral wall having an open outer extremity and having an inner extremity closed by a base member attached to said inner extremity of said peripheral wall;

a generally cylindrical sump housing attached into said collar; and means for sealingly attaching said sump housing to said sump collar, whereby said sump housing and said sump collar form a liquid containment chamber.

7. The sump assembly of claim 6 wherein said aperture extends through an upwardly facing portion of said tank wall.

8. The sump assembly of claim 7 further comprising a layer of sheet material applied over the exterior of said tank after said sump collar is attached but before said sump housing is attached, said sheet material being absent from the exterior portion of said tank surrounded by said sump collar, such that said collar open outer extremity has substantially none of said sheet material covering it.

9. The sump assembly of claim 8 further comprising at least one fluid conduit passing through said base member.

10. The sump assembly of claim 9 further comprising a whistle pipe passing through said sump collar, said whistle pipe comprising a tube extending downwardly through said base member and then curving upwardly such that a first end of said tube is adjacent an upper surface of the interior of said tank with a second end of said tube extending within said sump housing and having a whistle activated by air flow therethrough.

* * * * *